US009260985B2

(12) United States Patent
Nakamura

(10) Patent No.: US 9,260,985 B2
(45) Date of Patent: Feb. 16, 2016

(54) VALVE TIMING CONTROL APPARATUS

(71) Applicant: DENSO CORPORATION, Kariya, Aichi-pref. (JP)

(72) Inventor: Takuji Nakamura, Kariya (JP)

(73) Assignee: DENSO CORPORATION, Kariya (JP)

( * ) Notice: Subject to any disclaimer, the term of this patent is extended or adjusted under 35 U.S.C. 154(b) by 3 days.

(21) Appl. No.: 14/276,137

(22) Filed: May 13, 2014

(65) Prior Publication Data

US 2014/0338619 A1 Nov. 20, 2014

(30) Foreign Application Priority Data

May 14, 2013 (JP) ..... 2013-102450

(51) Int. Cl.
*F01L 1/34* (2006.01)
*F01L 1/344* (2006.01)

(52) U.S. Cl.
CPC ..... *F01L 1/3442* (2013.01); *F01L 2001/34456* (2013.01); *F01L 2001/34469* (2013.01)

(58) Field of Classification Search
CPC ..... F01L 1/3442; F16B 31/06
See application file for complete search history.

(56) References Cited

U.S. PATENT DOCUMENTS

| | | | | |
|---|---|---|---|---|
| 4,230,016 | A * | 10/1980 | Merrell | 411/378 |
| 2005/0252467 | A1 | 11/2005 | Strauss et al. | |
| 2005/0252561 | A1 | 11/2005 | Strauss et al. | |
| 2007/0204824 | A1 | 9/2007 | Strauss et al. | |
| 2011/0168112 | A1 * | 7/2011 | Noguchi et al. | 123/90.15 |

FOREIGN PATENT DOCUMENTS

| | | |
|---|---|---|
| JP | 2011-256772 | 12/2011 |
| WO | WO 2008/004362 | 1/2008 |

OTHER PUBLICATIONS

Office Action (2 pages) dated Mar. 19, 2015, issued in corresponding Japanese Application No. 2013-102450 and English translation (2 pages).

* cited by examiner

*Primary Examiner* — Thomas Denion
*Assistant Examiner* — Daniel Bernstein
(74) *Attorney, Agent, or Firm* — Nixon & Vanderhye P.C.

(57) ABSTRACT

A seat surface of a flat head bolt and a seat surface of a front plate are in contact with each other such that a tightening axial tension acts at an axial tension action point in an axial cross-section. A normal vector is perpendicular to the seat surface of the front plate and passes through the axial tension action point in the axial cross-section. An axial tension reach point is an intersection point between the normal vector and a shoe front surface in the axial cross-section. The normal vector intersects the shoe front surface at the axial tension reach point in the axial cross-section, and the axial tension reach point is included in a range of a shoe part.

6 Claims, 15 Drawing Sheets

VALVE TIMING CONTROL APPARATUS

CROSS REFERENCE TO RELATED APPLICATION

This application is based on Japanese Patent Application No. 2013-102450 filed on May 14, 2013, the disclosure of which is incorporated herein by reference in its entirety.

TECHNICAL FIELD

The present disclosure relates to a valve timing control apparatus which controls opening-and-closing timing of an intake valve or an exhaust valve of an internal combustion engine.

BACKGROUND

A vane-type valve timing control apparatus is known, which controls opening-and-closing timing of an intake valve or an exhaust valve by changing a rotation phase between a driving shaft and a driven shaft of an internal combustion engine. The vane-type valve timing control apparatus is equipped with a housing integrally rotating with the driving shaft and a vane rotor integrally fixed to the driven shaft inside the housing, and relatively rotates the vane rotor by supplying operation oil to a pressure chamber defined in the housing, such that the opening-and-closing timing is controlled.

Generally, in this kind of valve timing control apparatus, a cylindrical shoe housing which accommodates the vane rotor is supported between a front plate and a rear plate in an axial direction. A tightening bolt penetrates a through hole defined in a shoe part of the shoe housing from the front plate side, and is tightened to a female thread hole defined in the rear plate. JP 2009-215881A (WO 2008/004362 A1) describes a flat (countersunk) head bolt as the tightening bolt.

The flat head bolt can reduce an axial length of the bolt which includes a bolt head, compared with a pan head bolt or a cap bolt. In case of the pan head bolt or the cap bolt, the tightening axial tension is applied in parallel. The seat surface of the flat head bolt and the seat surface of the front plate have taper shape with cone angle of about 90 degrees. So, in case of the flat head bolt, the tightening axial tension spreads outward in the radial direction which is the direction of the normal to the seat surface. Therefore, depending on the size and the position of the shoe part of the shoe housing, a part or all of the range to which the tightening axial tension is applied may become outside of the shoe part. In this case, the tightening axial tension is not effectively transmitted to the shoe part, and there is a possibility that the shoe housing has a looseness and a position deviation in the rotational direction due to the impulse force and vibration accompanying the operation of the vane rotor.

If the tightening torque is simply increased too much to be larger than a proper torque, the flat head bolt may have fracture.

SUMMARY

It is an object of the present disclosure to provide a valve timing control apparatus, in which a front plate is tightened to a shoe housing using a flat head bolt by efficiently transmitting the tightening axial tension to the shoe housing.

According to the present disclosure, a valve timing control apparatus which controls opening-and-closing timing of an intake valve or an exhaust valve driven by a driven shaft by changing the rotation phase of a driving shaft to the driven shaft in an internal combustion engine is equipped with a shoe housing, a vane rotor, a front plate, a rear plate, and a flat head bolt.

The shoe housing has a pipe part and plural shoe parts projected inward in the radial direction from the inner wall of the pipe part, and rotates with one of the driving shaft or the driven shaft.

The vane rotor has a boss part which is provided coaxially with the pipe part of the shoe housing, and plural vane parts radially projected from the boss part. The vane part is accommodated between the shoe parts in the shoe housing so as to relatively rotate relative to the shoe part, and rotates integrally with the other of the driving shaft and the driven shaft.

The front plate is fixed to the shoe housing in the state where the front plate is in contact with a shoe front surface (an axial end surface) of the shoe housing. The front plate has a seat surface with a concave taper shape at a position corresponding to the shoe part. A diameter of the concave taper shape is decreased as going toward the inner side from the outer side in the axial direction.

The rear plate is fixed to the shoe housing in the state where the rear plate is in contact with a shoe rear surface (the other axial end surface) of the shoe housing.

The flat head bolt has a seat surface with a convex taper shape at the head, and the seat surface of the flat head bolt is seated on the seat surface of the front plate. The flat head bolt passes through a through hole defined in the shoe part of the shoe housing, so as to tighten the front plate and the rear plate with each other. Alternatively, the flat head bolt is engaged with a female thread hole defined in the shoe part, so as to directly tighten the front plate to the shoe housing.

In the axial cross-section, the seat surface of the flat head bolt and the seat surface of the front plate are in contact with each other such at an axial tension action point to which a tightening axial tension acts. A normal vector which passes through the axial tension action point and is perpendicular to the seat surface intersects the shoe front surface at an axial tension reach point as an intersection. The axial tension reach point is included in the range of the shoe part.

Here, the term of "front plate" and "rear plate" is defined base on a viewpoint in a tightening work using the flat head bolt. Spatial relationship between the front plate and the rear plate is not determined on the basis of the position in the engine, the driven shaft, etc.

According to the present disclosure, since the normal vector passing through the axial tension action point is contained in the shoe part, a part or all of the tightening axial tension is restricted from spreading and deviating to the outside of the shoe part. Therefore, the tightening axial tension can be efficiently transmitted to the shoe housing, without increasing the tightening torque.

Generally, the seat surface of the flat head bolt is set to have tolerance on the plus side from 90 degrees, and the seat surface of the front plate which receives the flat head bolt is set to have tolerance on the minus side from 90 degrees. Therefore, in the axial cross-section, the intersection point between the head end surface and the seat surface of the flat head bolt corresponds to an axial tension action point.

In the premise where the size or position of the shoe part of the shoe housing is not changed, according to the present disclosure, the axial tension action point is shifted inward in the radial direction relative to the general structure. Furthermore, in the premise where the thickness of the front plate and the position of the head end surface of the flat head bolt are not changed, the axial tension action point is shifted inward in the radial direction as the following.

For example, the seat surface of the flat head bolt has a first outer wall adjacent to a screw part, and a second outer wall adjacent to a head end surface. The axial tension action point is located between the first outer wall and the second outer wall as a border. The convex taper angle of the first outer wall of the flat head bolt is larger than the concave taper angle of the seat surface of the front plate. The convex taper angle of the second outer wall of the flat head bolt is smaller than the concave taper angle of the seat surface of the front plate.

Alternatively, the seat surface of the front plate has a first inner wall adjacent to a screw part and a second inner wall adjacent to a head end surface. The axial tension action point is located between the first inner wall and the second inner wall as a border. The concave taper angle of the first inner wall of the front plate is smaller than the convex taper angle of the seat surface of the flat head bolt. The concave taper angle of the second inner wall of the front plate is larger than the convex taper angle of the seat surface of the flat head bolt.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
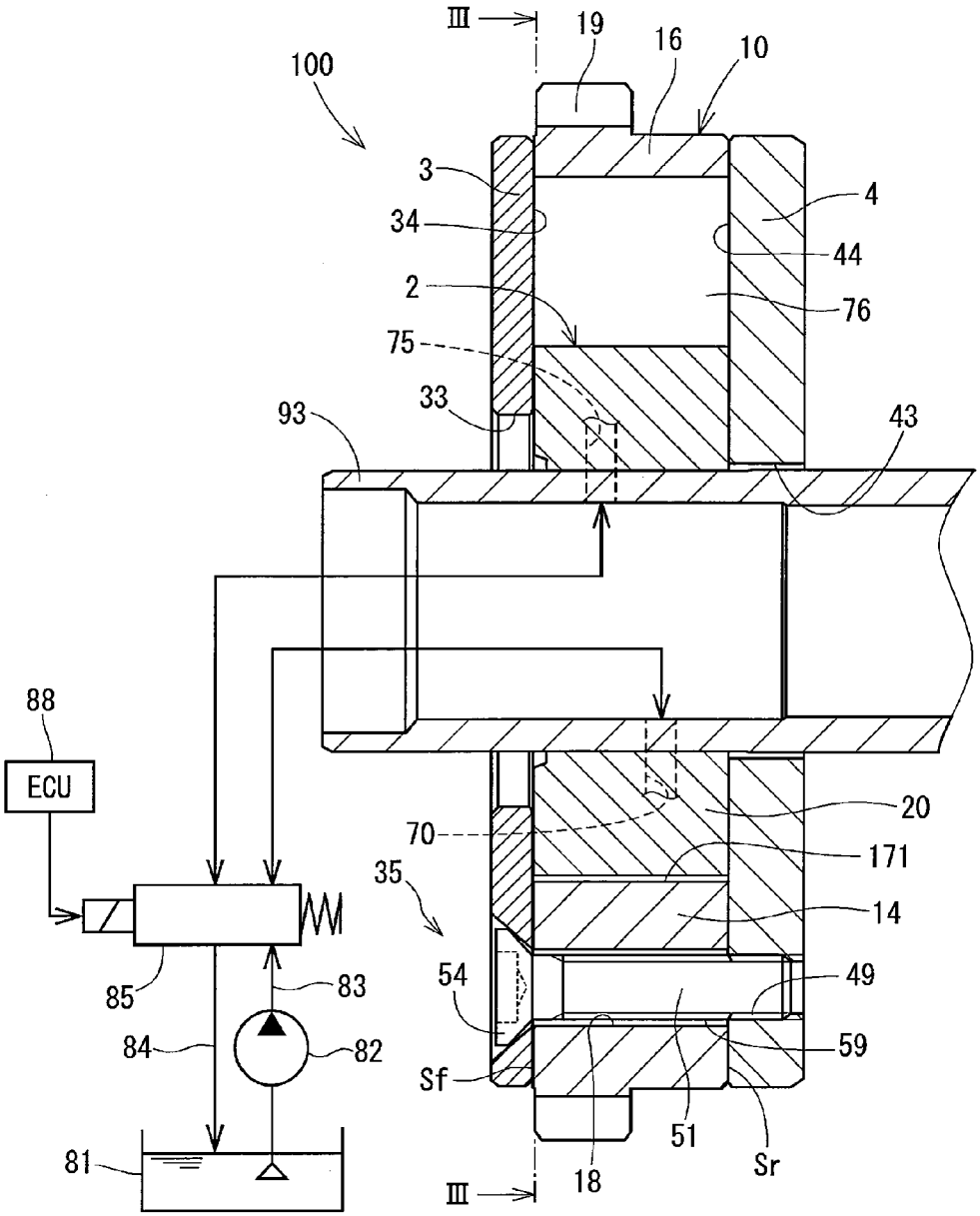
FIG. 1 is a schematic sectional view illustrating a valve timing control apparatus according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

Figure 2:
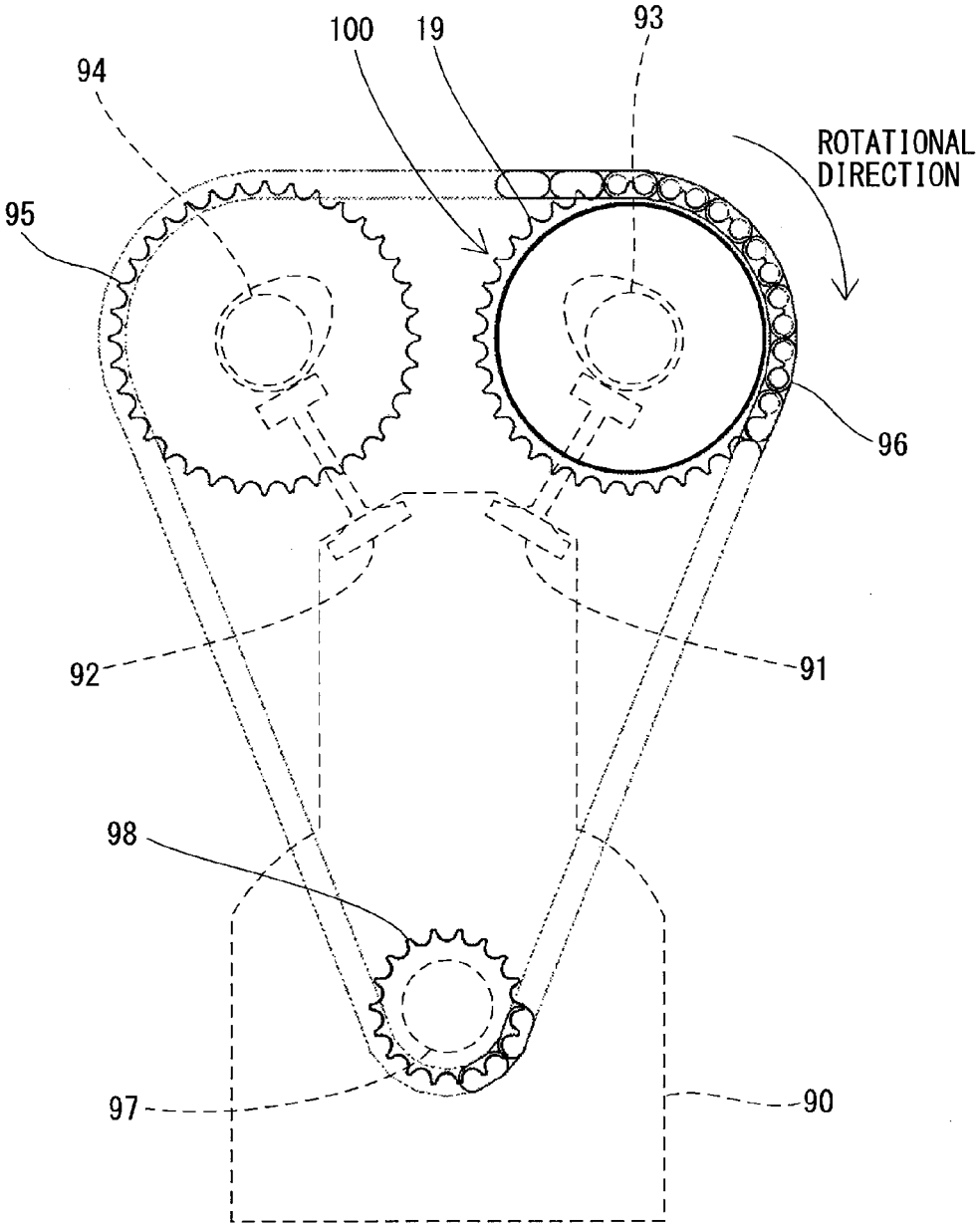
FIG. 2 is a schematic view illustrating an internal combustion engine to which the valve timing control apparatus of FIG. 1 is applied.

A valve timing control apparatus 100 according to a first embodiment controls opening-and-closing timing of an intake valve 91 of an internal combustion engine 90 shown in FIG. 2. As shown in FIG. 2, rotation of the driving shaft gear 98 of the crankshaft 97 of the engine 90 is transmitted to the camshaft 93, 94 through the chain 96 wound around the intake valve gear 19, the exhaust valve gear 95, and the driving shaft gear 98 of the valve timing control apparatus 100. The camshaft 93 rotates the intake valve 91, and the camshaft 94 rotates the exhaust valve 92. The crankshaft 97 may correspond to a driving shaft, and the camshaft 93, 94 may correspond to a driven shaft.

The valve timing control apparatus 100 advances the opening-and-closing timing of the intake valve 91 by relatively rotating the camshaft 93 on the advance side in the rotational direction relative to the gear 19 rotating with the crankshaft 97. Thus, in order to make the opening-and-closing timing of the intake valve 91 early, the camshaft 93 is relatively rotated, and this is referred to as "advance".

The valve timing control apparatus 100 retards the opening-and-closing timing of the intake valve 91 by relatively rotating the camshaft 93 on the retard side in the rotational direction relative to the gear 19 rotating with the crankshaft 97. Thus, in order to make the opening-and-closing timing of the intake valve 91 late, the camshaft 93 is relatively rotated, and this is referred to as "retard".

The valve timing control apparatus 100 is explained with reference to FIG. 1, FIG. 3, and FIG. 4. The valve timing control apparatus 100 mainly includes a shoe housing 10 which rotates with the crankshaft 97, a front plate 3, a rear plate 4, and a vane rotor 2 which rotates with the camshaft 93. The valve timing control apparatus 100 adjusts the rotation phase of the vane rotor 2 relative to the shoe housing 10 using the oil pressure of the operation oil supplied via an oil passage change valve 85 from an external oil pump 82. Thus, the rotation phase of the camshaft 93 to the crankshaft 97 is adjusted.

As shown in FIG. 1, the valve timing control apparatus 100 is driven by the external oil pump 82, the oil passage change valve 85, and an electrical control unit 88. In this embodiment, the oil passage change valve 85 is put inside the camshaft 93 having a hollow pipe shape. In FIG. 1, an oil passage which communicates the exit ports of the oil passage change valve 85 to an advance oil passage 70 and a retard oil passage 75 of the valve timing control apparatus 100 is schematically shown in the arrow direction.

The oil passage change valve 85 is, for example, an electromagnetism type, and has two entrance ports and the two exit ports. The position of the oil passage change valve 85 is switched among three positions. One of the entrance ports is connected to the supply oil passage 83 which supplies the operation oil pumped by the oil pump 82 from the oil pan 81.

The other of the entrance ports is connected to the discharge oil passage 84 through which the operation oil is returned to the oil pan 81 from the valve timing control apparatus 100. The exit ports are respectively connected to the advance oil passage 70 and the retard oil passage 75 of the valve timing control apparatus 100.

The electrical control unit 88 controls the position in the oil passage change valve 85 to relatively rotate the vane rotor 2 to a desired position based on a deviation between the actual phase and a target rotation phase of the vane rotor 2 to the shoe housing 10. The oil passage change valve 85 is switched among the three positions, i.e., positive communicate position, negative communicate position, and interception position, according to instructions output from the electrical control unit 88. At the positive communicate position, the supply oil passage 83 and the advance oil passage 70 communicate with each other, and the discharge oil passage 84 and the retard oil passage 75 communicate with each other. At the negative communicate position, the supply oil passage 83 and the retard oil passage 75 communicate with each other, and the discharge oil passage 84 and the advance oil passage 70 communicate with each other. At the interception position, the communication is intercepted for any of the oil passages.

The details of the valve timing control apparatus 100 are explained.

The shoe housing 10 integrally has the pipe part 16, the shoe parts 11, 12, 13, 14, and the gear 19. The pipe part 16 is arranged coaxially with the camshaft 93. The shoe parts 11, 12, 13, 14 are projected inward in the radial direction from the inner wall of the pipe part 16, and are arranged in the circumferential direction with an interval space.

The gear 19 is formed around the outer wall of the pipe part 16, and corresponds to the intake valve gear in this embodiment, so the power of the crankshaft 97 is transmitted through the chain 96.

The vane rotor 2 integrally has the boss part 20 which is prepared coaxially with the pipe part 16 of the shoe housing 10, and the vane parts 21, 22, 23, 24 projected from the boss part 20 radially outward in the radial direction. The vane rotor 2 is accommodated in the shoe housing 10 so that the boss part 20 is located on the inner side of the shoe part 11, 12, 13, 14 in the radial direction and that the vane part 21, 22, 23, 24 is located between the shoe parts 11, 12, 13 14 adjacent to each other in the circumferential direction.

The boss part 20 is coaxially fixed to the radially outer wall of the camshaft 93, for example, by press-fitting. Thereby, the vane rotor 2 rotates integrally with the camshaft 93.

In the state where the boss part 20 is accommodated in the shoe housing 10, the boss part 20 is rotatably supported by the radially inner end 171 of the shoe part 11, 12, 13, 14. The vane part 21, 22, 23, 24 is able to relatively rotate between the shoe parts 11, 12, 13, 14 in the circumferential direction, within a predetermined angle range.

The number of the shoe parts 11, 12, 13, 14 and the number of the vane parts 21, 22, 23, 24 are four in this embodiment, but are not limited to four in other embodiment.

Advance chambers 71, 72, 73, 74 and retard chambers 76, 77, 78, 79 are defined by the boss part 20, the vane parts 21, 22, 23, 24, the pipe part 16 and the shoe parts 11, 12, 13, 14 of the shoe housing 10. The advance chambers 71, 72, 73, 74 and the retard chambers 76, 77, 78, 79 are partitioned by the front plate 3 and the rear plate 4 in the axial direction.

Figure 3:
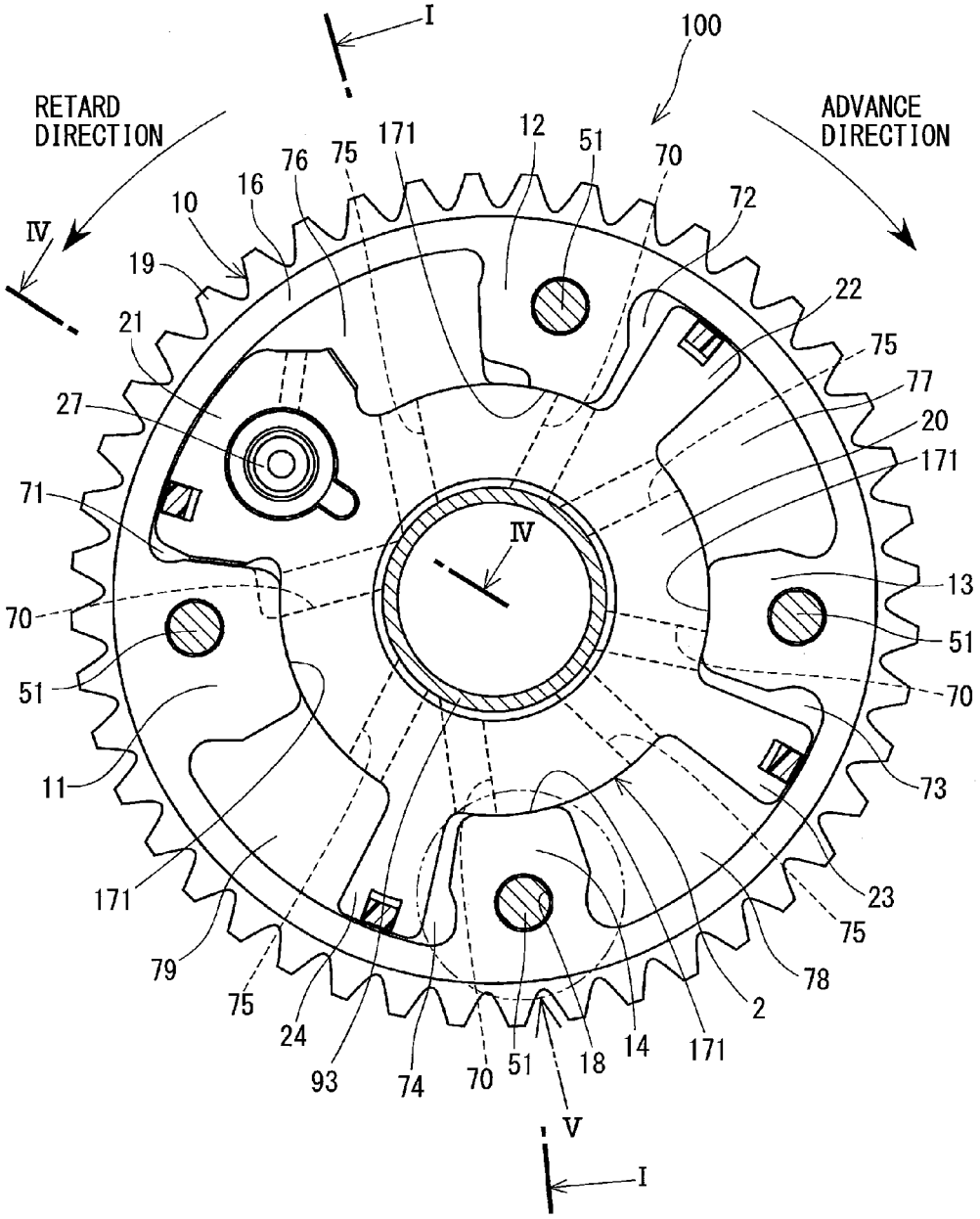
FIG. 3 is a sectional view taken along a line of FIG. 1.

In FIG. 3, the advance chamber 71, 72, 73, 74 is formed from the vane part 21, 22, 23, 24 to the shoe part 11, 12, 13, 14 in a direction of counterclockwise rotation. The retard chamber 76, 77, 78, 79 is formed from the vane part 21, 22, 23, 24 to the shoe part 12, 13, 14, 11 in a direction of clockwise rotation.

Moreover, the advance oil passage 70 which communicates and supplies operation oil to the advance chambers 71, 72, 73, 74, and the retard oil passage 75 which communicates and supplies operation oil to the retard chambers 76, 77, 78, 79 are formed in the vane rotor 2.

When the pressure of the operation oil in the advance chambers 71, 72, 73, 74 is higher than the pressure of the operation oil in the retard chambers 76, 77, 78, 79, the vane rotor 2 is relatively rotated in the advance direction. When the pressure of the operation oil in the retard chambers 76, 77, 78, 79 is higher than the pressure of the operation oil in the advance chambers 71, 72, 73, 74, the vane rotor 2 is relatively rotated in the retard direction. In this embodiment, at a timing when the engine is started, the vane rotor 2 is positioned at the maximum retard position shown in FIG. 3.

Figure 4:
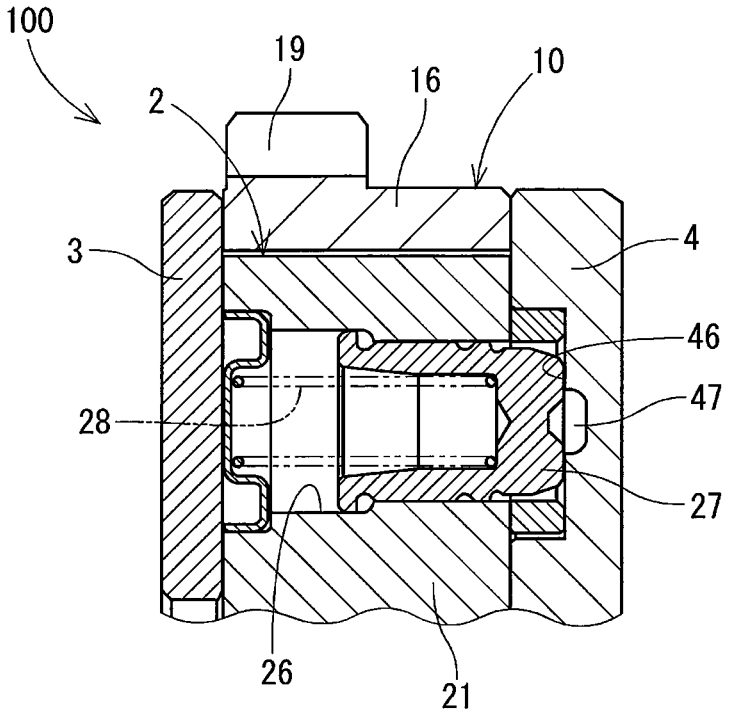
FIG. 4 is a sectional view taken along a line IV-IV of FIG. 3.

As shown in FIG. 4, the vane part 21 has an accommodation hole 26 passing through the vane part 21 in the axial direction, and a lock pin 27 is accommodated in the accommodation hole 26 reciprocateably in the axial direction. The lock pin 27 is biased by a spring 28 toward the rear plate 4 from the front plate 3.

The rear plate 4 has a fitting recess portion 46 to which the tip part of the lock pin 27 can be fitted at a position where the tip part of the lock pin 27 opposes at the maximum retard position of the vane rotor 2. An oil pressure chamber 47 is further defined at the bottom of the fitting recess portion 46, and the operation oil is introduced into the oil pressure chamber 47.

In this embodiment, the lock pin 27 is fitted to the fitting recess portion 46 at the maximum retard position which is a position at the timing starting the engine, such that the relative rotation of the vane rotor 2 is regulated.

As shown in FIG. 1, the end surface 34 of the front plate 3 is in contact with the shoe front surface Sf which is one axial end surface of the shoe housing 10, and closes one opening of the shoe housing 10. The end surface 44 of the rear plate 4 is in contact with the shoe rear surface Sr which is the other axial end surface of the shoe housing 10, and closes the other opening of the shoe housing 10.

Figure 6A:
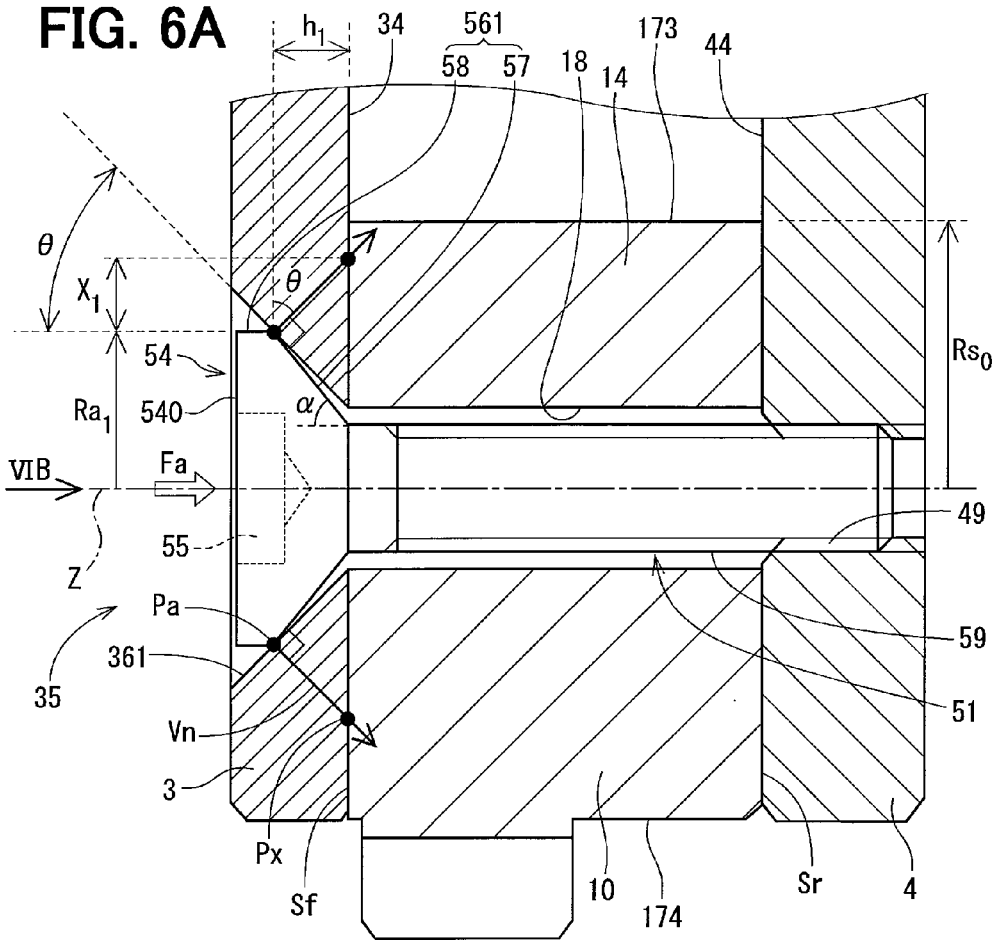
FIG. 6A is a schematic cross-sectional view taken along a line VIA-VIA of FIG. 5 in the valve timing control apparatus of the first embodiment.
Figure 6B:
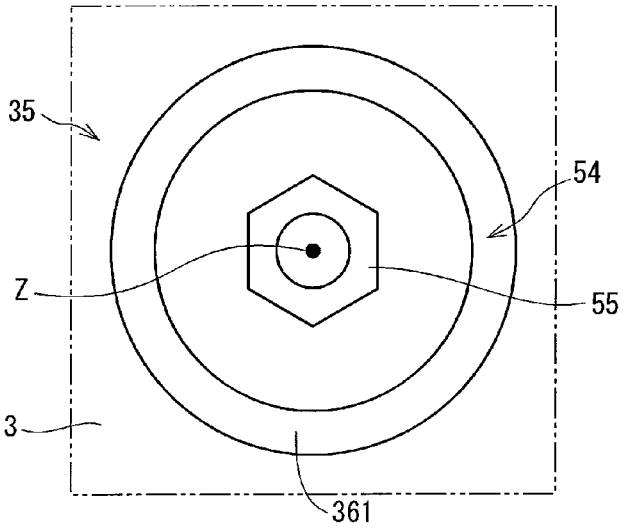
FIG. 6B is a front view illustrating the valve timing control apparatus of the first embodiment seen from a direction VIB of FIG. 6A.

The front plate 3 has a tightening part 35 which receives a head 54 of a flat head bolt 51 at a position corresponding to the through hole 18 defined in the shoe part 11, 12, 13, 14 of the shoe housing 10. As shown in FIG. 6A and FIG. 6B, the tightening part 35 has a seat surface 361 having a concave taper shape. The diameter of the seat surface 361 is decreased as extending from the outer side toward the inner side. The rear plate 4 has a female thread hole 49 engaging with a screw part 59 of the flat head bolt 51 at a position corresponding to the through hole 18.

The front plate 3 and the rear plate 4 are integrally fixed to the shoe housing 10 by being tightened by the flat head bolt 51, such that the shoe housing 10 is supported between the front plate 3 and the rear plate 4. Moreover, as shown in FIG. 1, the front plate 3 has a through hole 33 through which the camshaft 93 passes at the center, and the rear plate 4 has a through hole 43 through which the camshaft 93 passes at the center.

Next, operation of the valve timing control apparatus 100 is explained.

When the vane rotor 2 is rotated in the advance direction from the retard side relative to the shoe housing 10, the oil passage change valve 85 is switched such that the supply oil passage 83 and the advance oil passage 70 communicate with each other, and that the discharge oil passage 84 and the retard oil passage 75 communicate with each other. The oil pump 82 supplies operation oil to the advance chambers 71, 72, 73, 74 via the supply oil passage 83 and the advance oil passage 70. On the other hand, the operation oil of the retard chambers 76, 77, 78, 79 is discharged to the oil pan 81 via the retard oil passage 75 and the discharge oil passage 84. Thereby, the vane rotor 2 is rotated in the advance direction relative to the shoe housing 10.

When the vane rotor 2 is rotated from the maximum retard position, for example, at the timing of starting the engine, operation oil is supplied also to the oil pressure chamber 47 directly adjacent to the lock pin 27 via an oil passage (not shown) from the advance oil passage 70. The operation oil supplied to the oil pressure chamber 47 presses the tip part of the lock pin 27, and the lock pin 27 is unlocked from the fitting recess portion 46, such that the vane rotor 2 becomes in the rotatable state.

When the vane rotor 2 is rotated in the retard direction from the advance side relative to the shoe housing 10, the oil passage change valve 85 is switched such that the supply oil passage 83 and the retard oil passage 75 communicate with each other, and that the discharge oil passage 84 and the advance oil passage 70 communicate with each other. The oil pump 82 supplies operation oil to the retard chambers 76, 77, 78, 79 via the supply oil passage 83 and the retard oil passage 75. On the other hand, the operation oil of the advance chambers 71, 72, 73, 74 is discharged to the oil pan 81 via the advance oil passage 70 and the discharge oil passage 84. Thereby, the vane rotor 2 is rotated in the retard direction relative to the shoe housing 10.

Next, the structure relating to the flat head bolt 51 is explained with reference to FIG. 5, FIG. 6A and FIG. 6B using the shoe part 14 shown in the lower part of FIG. 3, among the four shoe parts 11, 12, 13, 14.

Figure 5:
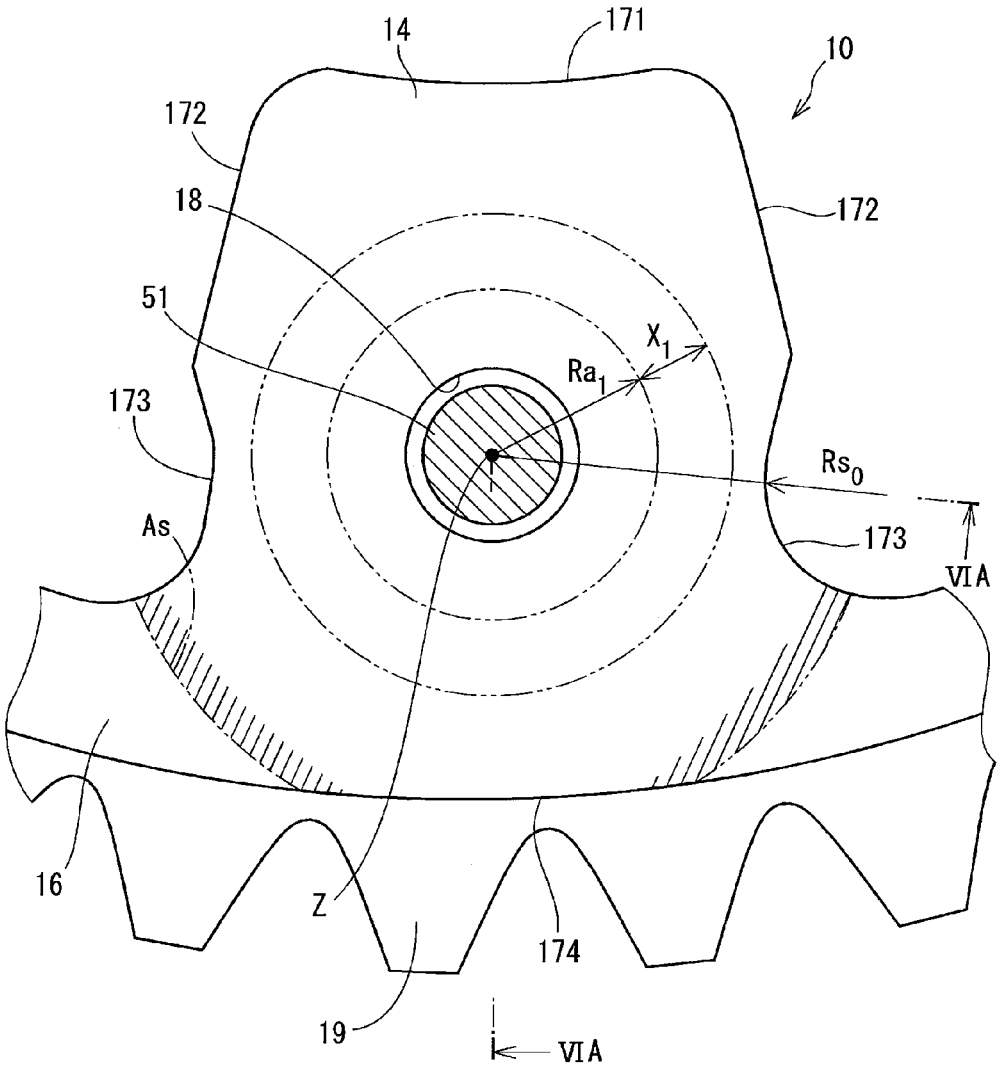
FIG. 5 is an enlarged view illustrating a shoe part in a circle area V of FIG. 3.

First, the range of the shoe part 14 is defined in FIG. 5. The radially inner end 171 of the shoe part 14 opposes the outer wall of the boss part 20 of the vane rotor 2. The shoe part 14 has a circumferential end 172 on both sides in the circumferential direction, and the circumferential end 172 opposes the vane part 21, 22, 23, 24 at the maximum retard position and the maximum advance position. The shoe part 14 has a cutout 173 which is recessed inward from the circumferential end 172. The cutout 173 is located between the pipe part 16 and the circumferential end 172 in the radial direction. The shoe part 14 has a radially outer end 174 which is equivalent to a perimeter part of the pipe part 16.

The flat head bolt 51 has a bolt axis Z, and a distance from the bolt axis Z becomes the shortest at the cutout 173. The shortest distance from the bolt axis Z is represented by $Rs_0$. Moreover, an imaginary circle is defined centering at the bolt axis Z, and the imaginary circle contains the cutout 173 and the radially outer end 174 inside. An arc-shaped segment of the imaginary circle is defined as a range As of the shoe part 14. That is, when the shoe part 14 and the pipe part 16 are connected with each other at a substantial portion, the substantial portion is included in the range As of the shoe part 14.

FIG. 6A is a sectional view taken along a line VIA-VIA of FIG. 5, and a portion upper than the bolt axis Z in FIG. 6A represents a cross-section at the shortest distance $Rs_0$ in the cutout 173.

The tightening part 35 of the front plate 3, the through hole 18 of the shoe housing 10, and the female thread hole 49 of the rear plate 4 are coaxially formed along the bolt axis Z. The tightening part 35 of the front plate 3 has the seat surface 361 having the concave taper shape, and the (cone) angle of the concave taper shape is about 90 degrees.

The flat head bolt 51 has the head 54 and the screw part 59, and passes through the through hole 18 of the shoe housing 10. The head 54 is adjacent to the front plate 3 and the screw part 59 is adjacent to the shoe housing 10 and the rear plate 4. The flat head bolt 51 is inserted toward the rear plate 4 from the front plate 3. The screw part 59 is engaged with the female thread hole 49 of the rear plate 4. In other words, the flat head bolt 51 is tightened by being inserted into the front plate 3, however, it is possible to tighten the flat head bolt 51 from the rear plate 4.

An end surface 540 of the head 54 of the flat head bolt 51 has a bit insertion part 55 to which a tightening tool is inserted. In this embodiment, the bit insertion part 55 is formed as a hexagon socket corresponding to a hexagon bit, however, it is possible that the bit insertion part 55 is formed as a cross recess or a shape corresponding to a special tool in other embodiment.

A part of the head 54 adjacent to the screw part 59 has a seat surface 561 with a convex taper shape. In this embodiment, the seat surface 561 has a first outer wall 57 adjacent to the screw part 59 and a second outer wall 58 adjacent to the end surface 540 away from the screw part 59. An angle is formed between the first outer wall 57 and the second outer wall 58, as two-step shape. The first outer wall 57 adjacent to the screw part 59 has a convex taper shape with a taper (cone) angle of about 90 degrees. The second outer wall 58 adjacent to the end surface 540 has a straight shape spreading parallel to the bolt axis Z, and is connected to the end surface 540.

The term of "seat surface 561" is used here in the sense of "a surface which is seated on the seat surface 361". Not all of the seat surface 561 necessarily is in contact with or approaches the seat surface 361. Specifically, the second outer wall 58 having the straight shape in FIG. 6A is distant from the seat surface 361 and is not suitable to the expression of "seated on" the seat surface 361. However, based on the above-mentioned definition, it considers that the second outer wall 58 up to the boundary relative to the end surface 540 is a part of "the seat surface 561" which is "the surface seated to the seat surface 361".

Moreover, "the seat surface 56 having a convex taper shape" means that the seat surface 561 which consists of the first outer wall 57 and the second outer wall 58 has a convex taper shape as a whole, and it does not require that each of the first outer wall 57 and the second outer wall 58 has a convex taper shape. Therefore, a case where the first outer wall 57 has a taper shape and where the second outer wall 58 has a straight shape corresponds to "the seat surface 561 having a convex taper shape."

The relationship between the convex taper angle of the first outer wall 57 of the seat surface 561 and the concave taper angle of the seat surface 361 is explained. The convex taper angle of the first outer wall 57 is set larger than the concave taper angle of the seat surface 361. Therefore, as shown in FIG. 6A, when the flat head bolt 51 is fixed, the seat surface 561 is in contact with the seat surface 361 at the boundary between the first outer wall 57 and the second outer wall 58, and a clearance is generated between the seat surface 561 and the seat surface 361 in an area adjacent to the screw part 59. In the axial cross-section shown in FIG. 6A, the seat surface 561 and the seat surface 361 are in contact with each other at an axial tension action point Pa. The axial tension action point Pa is a point at which the axial tension is applied, and may be referred as an axial tension lever point.

FIG. 6A exaggeratedly shows the difference between the taper angles. Generally, the taper angles are set to have slight and minor difference from each other. Specifically, the convex taper angle of the seat surface 561 is set to have tolerance on the plus side from 90 degrees, and the concave taper angle of the seat surface 361 is set to have tolerance on the minus side from 90 degrees, for example.

Figure 7:
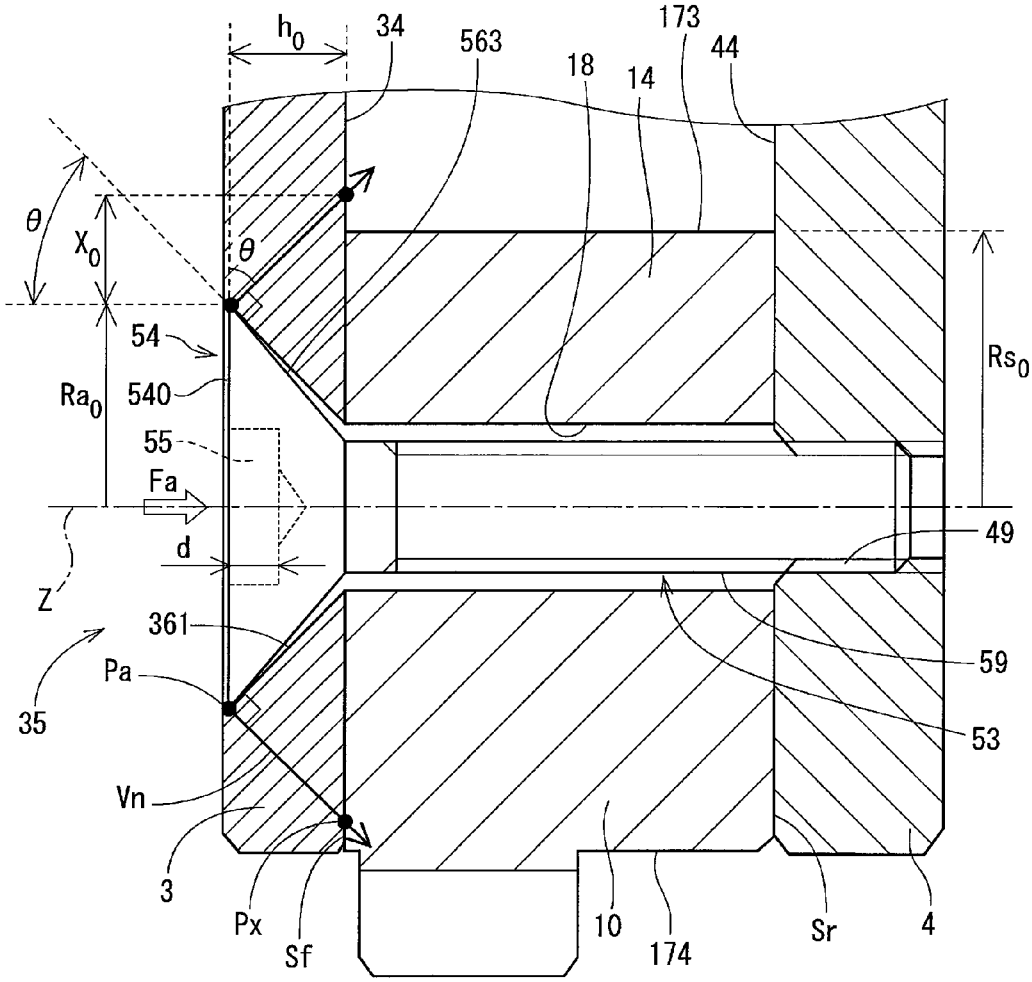
FIG. 7 is a schematic cross-sectional view illustrating a valve timing control apparatus of a comparative example.

The positional relationship between the seat surface 561 of the flat head bolt 51 and the seat surface 361 of the front plate 3 is explained in contrast to a comparative example shown in FIG. 7 in which a common flat head bolt is used.

As shown in FIG. 7, a flat head bolt 53 of the comparative example has a seat surface 563 having a simple convex taper shape where the cross-section is expressed in a straight line. The convex taper angle of the seat surface 563 is set to be larger than the concave taper angle of the seat surface 361. Therefore, in the axial cross-section, the flat head bolt 53 of the comparative example has an axial tension action point Pa which is represented by an intersection point between the head end surface 540 and the seat surface 563.

At this time, a height $h_0$ from the shoe front surface Sf to the axial tension action point Pa in the axial direction, a radius $Ra_0$ from the bolt axis Z to the axial tension action point Pa, and a diffusion length $X_0$ are shown in FIG. 7. When an axial tension reach point Px is defined by an intersection point between the shoe front surface Sf and a normal vector Vn which is perpendicular to the seat surface 361 and passing through the axial tension action point Pa, the diffusion length $X_0$ represents a distance in the radial direction between the axial tension action point Pa and the axial tension reach point Px. That is, the axial tension Fa tightening the flat head bolt 51 and starting from the axial tension action point Pa is diffused outward in the radial direction by the diffusion length $X_0$ until reaching the axial tension reach point Px of the shoe front surface Sf.

The term of "diffusion" is used not in the physical meaning but in the mechanical meaning, that means, the vector of the force spreads from the starting point outward in the radial direction.

In the cross-section adjacent to the cutout 173 above the bolt axis Z in FIG. 7, the axial tension reach point Px is out of the range of the shoe part 14, because the axial tension reach point Px is located on the outer side of the cutout 173 in the radial direction. When a shortest distance from the bolt axis Z to the cutout 173 is defined as $Rs_0$ in FIG. 7, the following formula 1.1 is satisfied.

$$Rs_0<Ra_0+X_0 \tag{1.1}$$

When a single-sided angle of the seat surface 361 relative to the bolt axis Z is defined as a seat slope θ (0 degree<θ<90 degrees), the diffusion length $X_0$ is expressed with the formula 1.2 using the height $h_0$ and the seat slope θ. In addition, the concave taper angle of the seat surface 361 is equivalent to 2θ.

$$X_0=h_0/\tan\theta \tag{1.2}$$

The seat slope θ is usually set as about 45 degrees. When the seat slope θ is 45 degrees, the relationship of $h_0=X_0$ is satisfied. Moreover, the seat slope θ is also an angle of the normal vector Vn relative to the shoe front surface Sf.

In the comparative example, the formula 1.3 is satisfied from the formula 1.1 and the formula 1.2.

$$(Rs_0-Ra_0)<(h_0/\tan\theta) \tag{1.3}$$

In such comparative example, the tightening axial tension Fa is not effectively transmitted to the shoe part 14 in a portion where the cutout 173 is included in the circumferential direction. Therefore, the shoe housing 10 may have a looseness and a position gap in the rotational direction, for example, by the impulse force and vibration accompanying the operation of the vane rotor 2. Moreover, if excessive torque is applied to the flat head bolt 53 to compensate the loss in the tightening axial tension Fa, the head 54 of the flat head bolt 53 may be damaged and the seat surface 361 may have compression buckling.

The numerical subscript "0" in the sign $Ra_0$, $X_0$, $h_0$, $Rs_0$ used in the comparative example may correspond to a standard in contrast with the following embodiment. In the following embodiment, if the value is the same as the comparative example, the same sign will be used. If the value is different from the comparative example, the subscript of the sign is changed.

Next, the first embodiment is explained with reference to FIG. 6A and FIG. 6B. In contrast to the comparative example, according to the first embodiment, the head 54 of the flat head bolt 51 is different, while the seat surface 361 of the front plate 3 and the shoe housing 10 are the same.

The seat surface 561 of the flat head bolt 51 has the first outer wall 57 adjacent to the screw part 59 with the convex taper angle of about 90 degrees, and the second outer wall 58 adjacent to the head end surface 540 with the straight shape, i.e., convex taper angle of about 0 degree. The boundary between the first outer wall 57 and the second outer wall 58 corresponds to the axial tension action point Pa at which the seat surface 561 is in contact with the seat surface 361, and the following relationship is satisfied about the taper angles.

The convex taper angle (=2α) of the first outer wall 57 adjacent to the screw part 59 is larger than the concave taper angle (=2θ) of the seat surface 361. The convex taper angle (=0 degree) of the second outer wall 58 adjacent to the head end surface 540 is smaller than the concave taper angle (=2θ) of the seat surface 361.

Thereby, in case where the position of the head end surface 540 is equivalent to that of the flat head bolt 53 of the comparative example, the action point height $h_1$ from the shoe front surface Sf to the axial tension action point Pa and the action point radius $Ra_1$ from the bolt axis Z to the axial tension action point Pa are smaller than the action point height $h_0$ and the action point radius $Ra_0$ of the comparative example, respectively. Since the seat slope θ is the same as the comparative example, the diffusion length $X_1(=h_1/\tan\theta)$ also becomes smaller than the diffusion length $X_0$ of the comparative example.

As a result, in the axial cross-section upper than the bolt axis Z and adjacent to the cutout 173 in FIG. 6A, the axial tension reach point Px is included in the range of the shoe part 14.

That is, according to the first embodiment, the formulas 1.4 and 1.5 are satisfied in contrast to the formulas 1.1 and 1.3 of the comparative example.

$$Rs_0\geq Ra_1+X_1 \tag{1.4}$$

$$(Rs_0-Ra_1)\geq(h_1/\tan\theta) \tag{1.5}$$

Here, as clearly shown in FIG. 6A, since the position of the axial tension reach point Px is located on the inner side than the cutout 173 in the radial direction, the "≥" of the formulas 1.4 and 1.5 can be replaced with ">". However, the first embodiment includes a case where the position of the axial tension reach point Px is in perfect agreement with the position of the cutout 173.

It can be said that the axial tension action point Pa is shifted inward in the radial direction in the first embodiment, compared with the comparative example.

According to the first embodiment, the tightening axial tension Fa is transmitted effectively to the shoe part 14. Therefore, the shoe housing 10 can be restricted from having looseness and position gap in the rotational direction arising by the impulse force or vibration accompanying the operation of the vane rotor 2. Moreover, since it is not necessary to apply excessive torque to the flat head bolt 51, the breakage in the head 54 of the flat head bolt 51 and the compression buckling of the seat surface 361 are avoidable.

According to the first embodiment, since the position of the head end surface 540 of the flat head bolt 51 is equivalent to the position of the head end surface 540 of the flat head bolt 53 of the comparative example, it is possible to appropriately secure the depth of the bit insertion part 55. Furthermore, it is easy to process since the second outer wall 58 of the seat surface 561 is formed into the straight shape.

A modification of the first embodiment is described with reference to FIG. 8.

As mentioned above, the seat surface 561 of the flat head bolt 51 of the first embodiment has the second outer wall 58 with the straight shape parallel to the bolt axis Z, which is equivalent to a convex taper angle of 0 degree.

Figure 8:
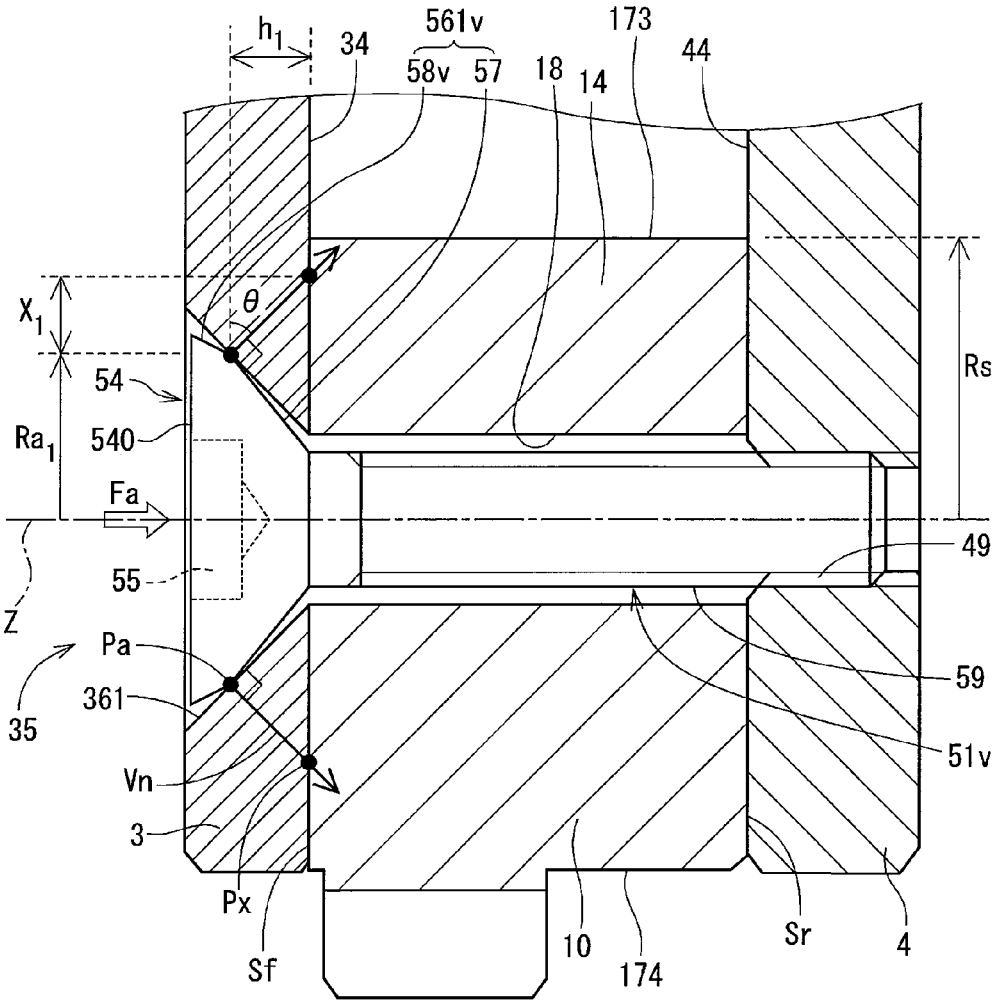
FIG. 8 is a schematic cross-sectional view illustrating a valve timing control apparatus according to a modification of the first embodiment.

In the modification, as shown in FIG. 8, the seat surface 561*v* of the flat head bolt 51*v* has the second outer wall 58*v* adjacent to the head end surface 540, and the second outer wall 58*v* has a convex taper angle of an acute angle which is smaller than the concave taper angle of the seat surface 361, instead of the straight shape. In this case, the convex taper angle of the first outer wall 57 adjacent to the screw part 59 is larger than the concave taper angle of the seat surface 361, and the convex taper angle of the second outer wall 58*v* adjacent to the head end surface 540 is smaller than the concave taper angle of the seat surface 361.

Furthermore, the convex taper angle of the second outer wall adjacent to the head end surface 540 may be "a negative convex taper angle" in which the diameter is smaller than that at the axial tension action point Pa.

(Second Embodiment)

Figure 9:
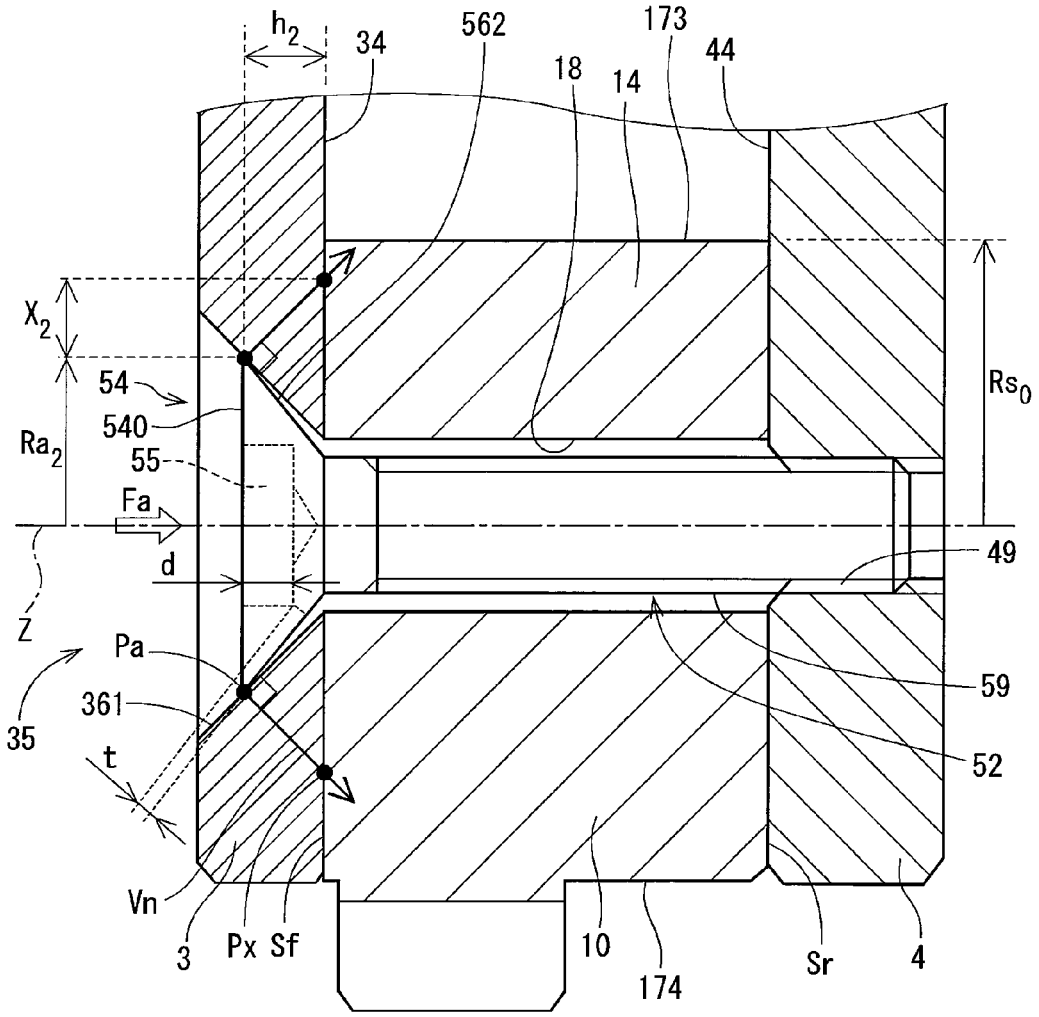
FIG. 9 is a schematic cross-sectional view illustrating a valve timing control apparatus according to a second embodiment.

In a second embodiment shown in FIG. 9, compared with the flat head bolt 53 (FIG. 7) of the comparative example, a flat head bolt 52 is used in which only the size of the head 54 is made small without changing the shape of the head 54. In the axial cross-section, the flat head bolt 52 has an axial tension action point Pa at the intersection between the head end surface 540 and the seat surface 562.

Thereby, the action point radius $Ra_2$, the action point height $h_2$, and the diffusion length $X_2$ of the second embodiment are smaller than the action point radius $Ra_0$, the action point height $h_0$, and the diffusion length $X_0$ of the comparative example, respectively. The normal vector Vn of the seat surface 361 intersects the shoe front surface Sf at the axial tension reach point Px, which is included in the range of the shoe part 14.

The features of the second embodiment are expressed with the formulas 2.1 and 2.2 which are according to the above-mentioned formulas 1.4 and 1.5.

$$Rs_0 \geq Ra_2 + X_2 \tag{2.1}$$

$$(Rs_0 - Ra_2) \geq (h_2/\tan\theta) \tag{2.2}$$

Therefore, the second embodiment achieves the same effect as the first embodiment.

If the straight portion of the head 54 of the flat head bolt 51 (FIG. 6A) of the first embodiment is cut, the structure in the second embodiment can be obtained. In other words, the flat head bolt 52 of the second embodiment is the remaining portion of the head 54, if the straight portion of the head 54 of the flat head bolt 51 (FIG. 6A) of the first embodiment is cut, between the axial tension action point Pa and the end adjacent to the screw part 59. That is, the shape of the head 54 becomes simple compared with the flat head bolt 51 of the first embodiment.

However, in this case, when the flat head bolt 52 of the second embodiment is set to have a same depth d in the bit insertion part 55 as the flat head bolt 53 (FIG. 7) of the comparative example, a thickness t of the thinnest part between the seat surface 562 and the corner of the bottom of the bit insertion part 55 becomes small. If the thickness t becomes smaller than a predetermined limit, the head 54 may fracture when the flat head bolt 52 is tightened by a tool.

Figure 10:
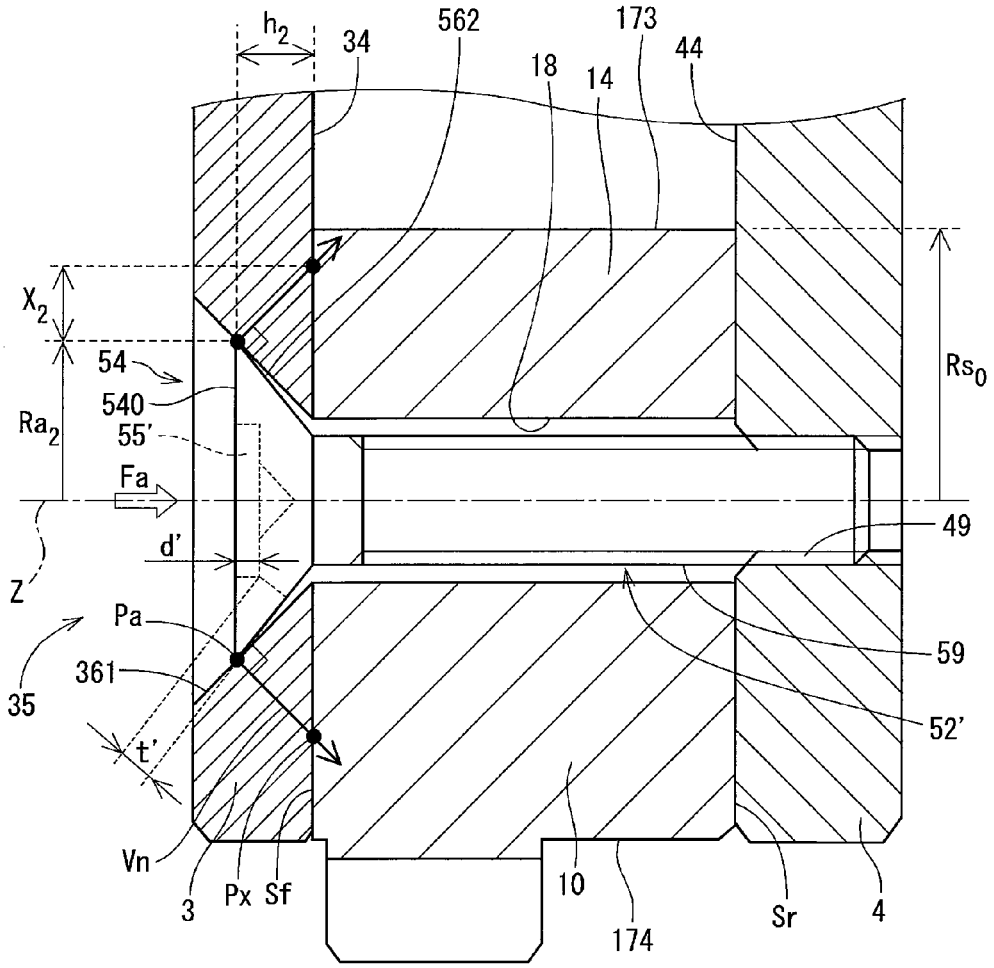
FIG. 10 is a schematic cross-sectional view illustrating a valve timing control apparatus according to a modification of the second embodiment.

In a modification of the second embodiment shown in FIG. 10, a flat head bolt 52' is used in which the depth d' of the bit insertion part 55' is made shallow, thereby increasing the thickness t' of the thinnest part, such that the strength of the head 54 can be secured. In this case, it is desirable to set the dimensions so that the engagement length between the tool and the bit insertion part 55' can be secured and that the thickness t' of the thinnest part can be secured.

(Third Embodiment)

Figure 11:
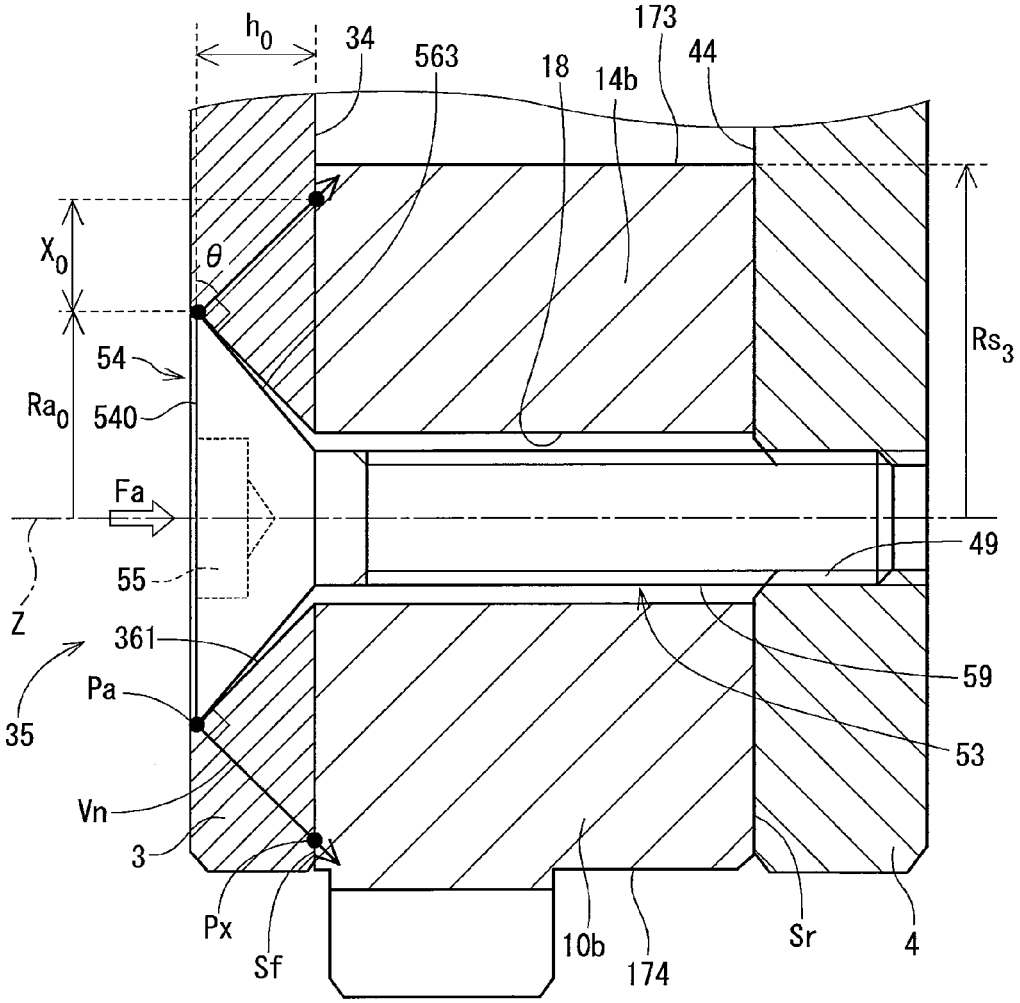
FIG. 11 is a schematic cross-sectional view illustrating a valve timing control apparatus according to a third embodiment.

In a third embodiment shown in FIG. 11, compared to the comparative example (FIG. 7), only the size of the shoe part 14*b* of the shoe housing 10*b* is different. That is, the distance $Rs_3$ from the bolt axis Z to the cutout 173 is set longer than the distance $Rs_0$ from the bolt axis Z to the cutout 173 in the comparative example or the first embodiment. Therefore, while the positions of the axial tension action point Pa and the normal vector Vn are made equivalent to the comparative example, the axial tension reach point Px can be included in the range of the shoe part 14*b*.

The features of the third embodiment are expressed with the formulas 3.1 and 3.2.

$$Rs_3 \geq Ra_0 + X_0 \tag{3.1}$$

$$(Rs_3 - Ra_0) \geq (h_0/\tan\theta) \tag{3.2}$$

Therefore, the third embodiment achieves the same effect as the first embodiment.

When the distance $Rs_3$ from the bolt axis Z to the cutout 173 is increased, the movable angle range of the vane rotor 2 is made narrow, or the outer diameter of the shoe housing 10 is increased. However, when such change does not pose a problem, by adopting the third embodiment using the common flat head bolt 53, the same effect can be acquired as the first embodiment.

(Fourth Embodiment)

Figure 12:
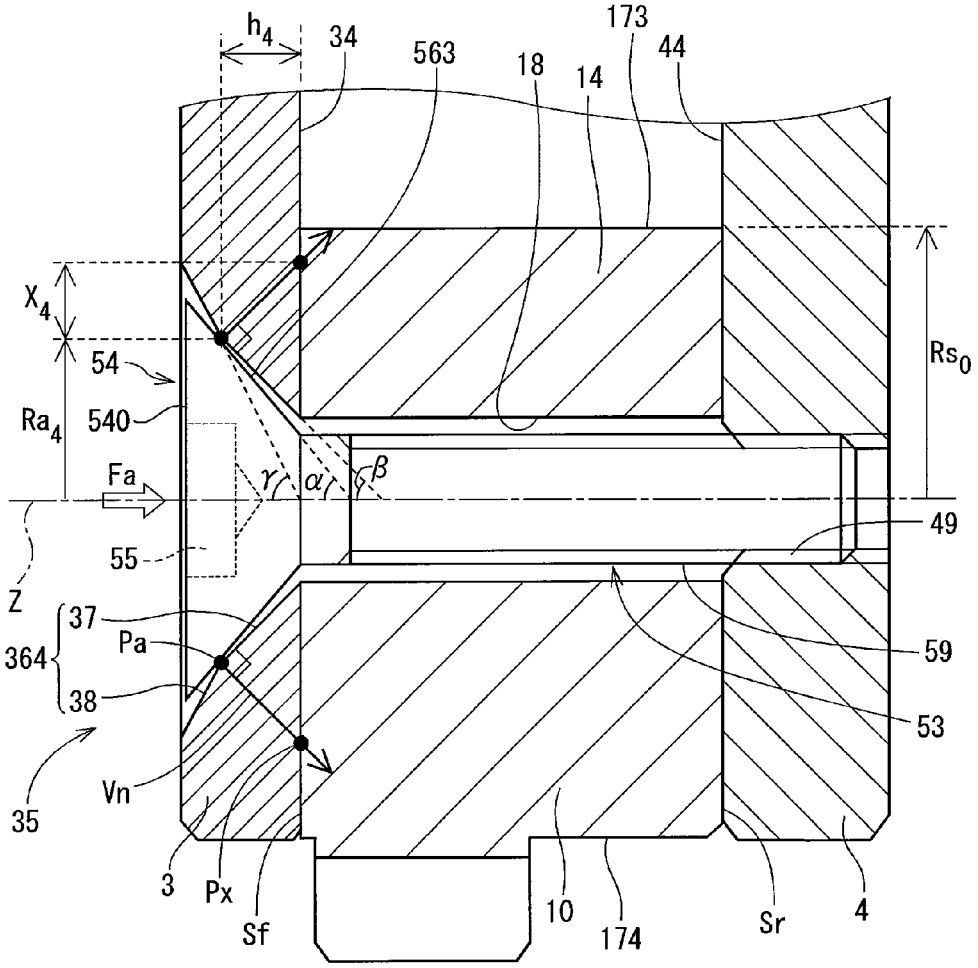
FIG. 12 is a schematic cross-sectional view illustrating a valve timing control apparatus according to a fourth embodiment.

In a fourth embodiment shown in FIG. 12, compared to the comparative example (FIG. 7), the seat surface 364 of the front plate 3 is constructed by the first inner wall 37 adjacent to the screw part 59 and the second inner wall 38 adjacent to the head end surface 540. The boundary between the first inner wall 37 and the second inner wall 38 serves as the axial tension action point Pa at which the seat surface 364 is in contact with the seat surface 563. The concave taper angle (=2β) of the first inner wall 37 is smaller than the convex taper angle (=2θ) of the seat surface 563. The concave taper angle (=2γ) of the second inner wall 38 is larger than the convex taper angle (=2θ) of the seat surface 563.

Thereby, when the flat head bolt 53 of the comparative example is used, the action point height $h_4$, the action point radius $Ra_4$ and the diffusion length $X_4$ of the fourth embodiment become smaller than the action point height $h_0$, the action point radius $Ra_0$, and the diffusion length $X_0$ of the comparative example, respectively, similarly to the first embodiment. As a result, the axial tension reach point Px is included in the range of the shoe part 14.

The axial tension action point Pa is shifted inward in the radial direction also in the fourth embodiment, compared with the comparative example.

The features of the fourth embodiment are expressed with the formulas 4.1 and 4.2.

$$Rs_0 \geq Ra_4 + X_4 \quad (4.1)$$

$$(Rs_0 - Ra_4) \geq (h_4/\tan\theta) \quad (4.2)$$

Therefore, the fourth embodiment achieves the same effect as the first embodiment.

(Fifth Embodiment)

Figure 13:
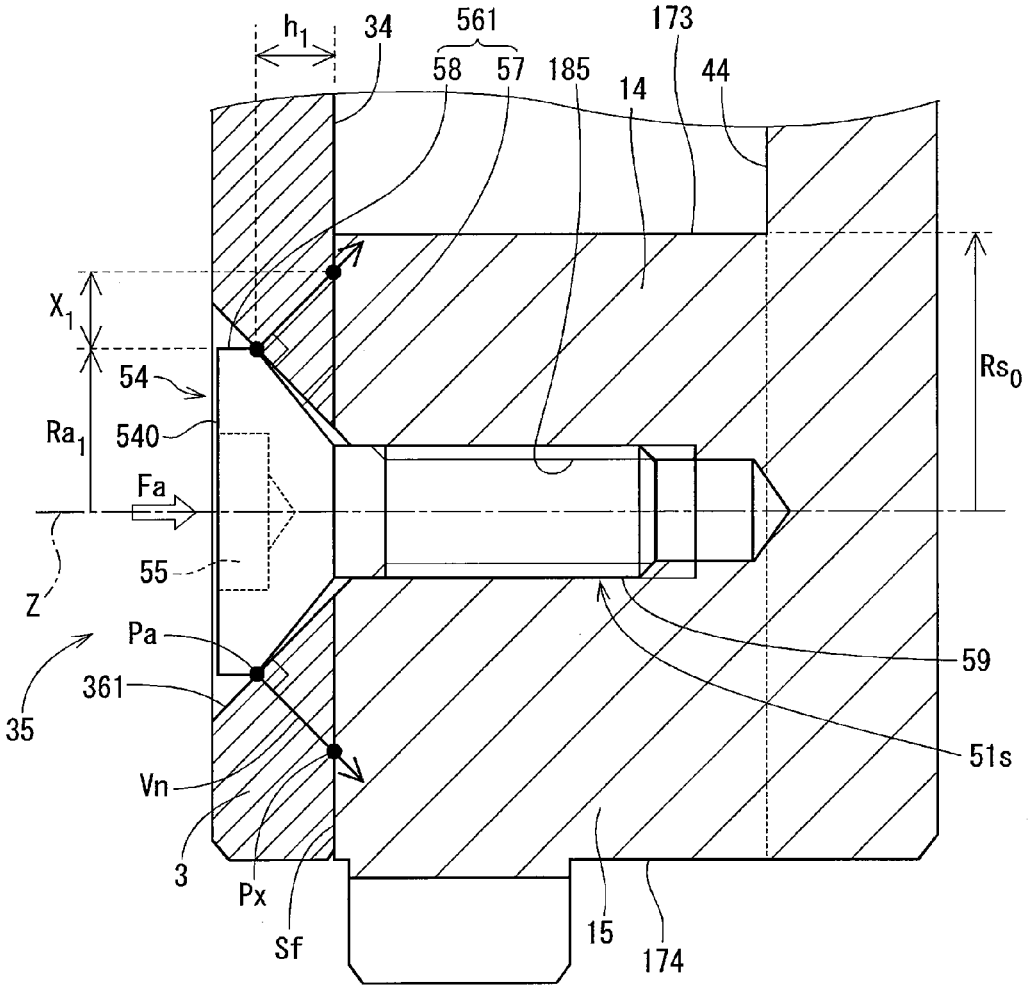
FIG. 13 is a schematic cross-sectional view illustrating a valve timing control apparatus according to a fifth embodiment.

In a fifth embodiment shown in FIG. 13, compared with the first embodiment, the shoe housing 15 is integrally formed with a rear plate. In other words, the shoe housing 15 is integrally molded with the rear plate as a single component in the primary fabrication stage, or the shoe housing 15 is integrally joined to the rear plate as one component at the preceding stage of the assembly process where the one component is joined to the front plate 3.

The flat head bolt 51*s* has an equivalent shape as the head 54 and is short in the full length, compared to the flat head bolt 51 of the first embodiment. The shoe housing 15 has a female thread hole 185 to which the flat head bolt 51*s* is possible to engage. In the fifth embodiment, the flat head bolt 51*s* is engaged with the female thread hole 185 of the shoe housing 15, such that the front plate 3 and the shoe housing 15 are directly tightened with each other.

The fifth embodiment also generates the same effect as the first embodiment.

(Sixth Embodiment)

Figure 14:
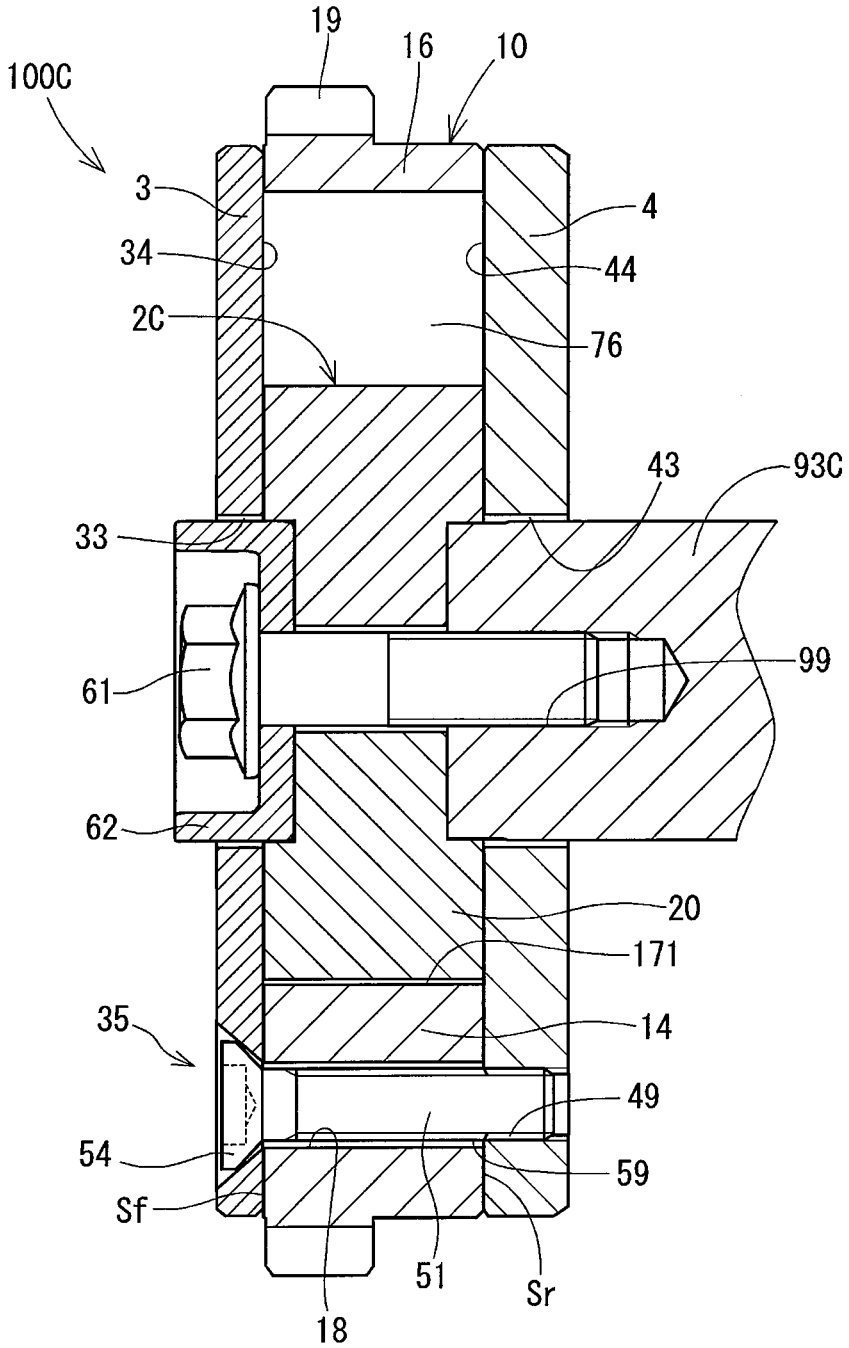
FIG. 14 is a schematic cross-sectional view illustrating a valve timing control apparatus according to a sixth embodiment.

In a sixth embodiment shown in FIG. 14, only the camshaft is different from that of the first embodiment. In a valve timing control apparatus 100C of the sixth embodiment, a camshaft 93C is a solid shaft in which a female thread hole 99 is formed at the center. A center washer 62 and the vane rotor 2C are supported between the center bolt 61 and the camshaft 93C, and the center bolt is engaged with the female thread hole 99 of the camshaft 93C. The shoe housing 10 and the flat head bolt 51 are the same as those of the first embodiment. In this embodiment, the oil passage change valve 85 (FIG. 1) is installed outside of the valve timing control apparatus 100C, and is connected through a piping.

The sixth embodiment also generates the same effect as the first embodiment.

(Other Embodiment)

In the above-mentioned embodiments, it is desirable that the axial tension reach point Px is included in the range of the shoe part in all the directions of the shoe part centering at the bolt axis Z.

However, in an actual product design, when determining the size and arrangement in consideration of a functional aspect, a strength aspect, a space aspect etc., it may be difficult to satisfy that the axial tension reach point Px is included in the range of the shoe part in all the directions. Then, actually, even if it does not necessarily satisfy the requirement in all the directions, the requirement may be satisfied relative to a predetermined standard.

Figure 15:
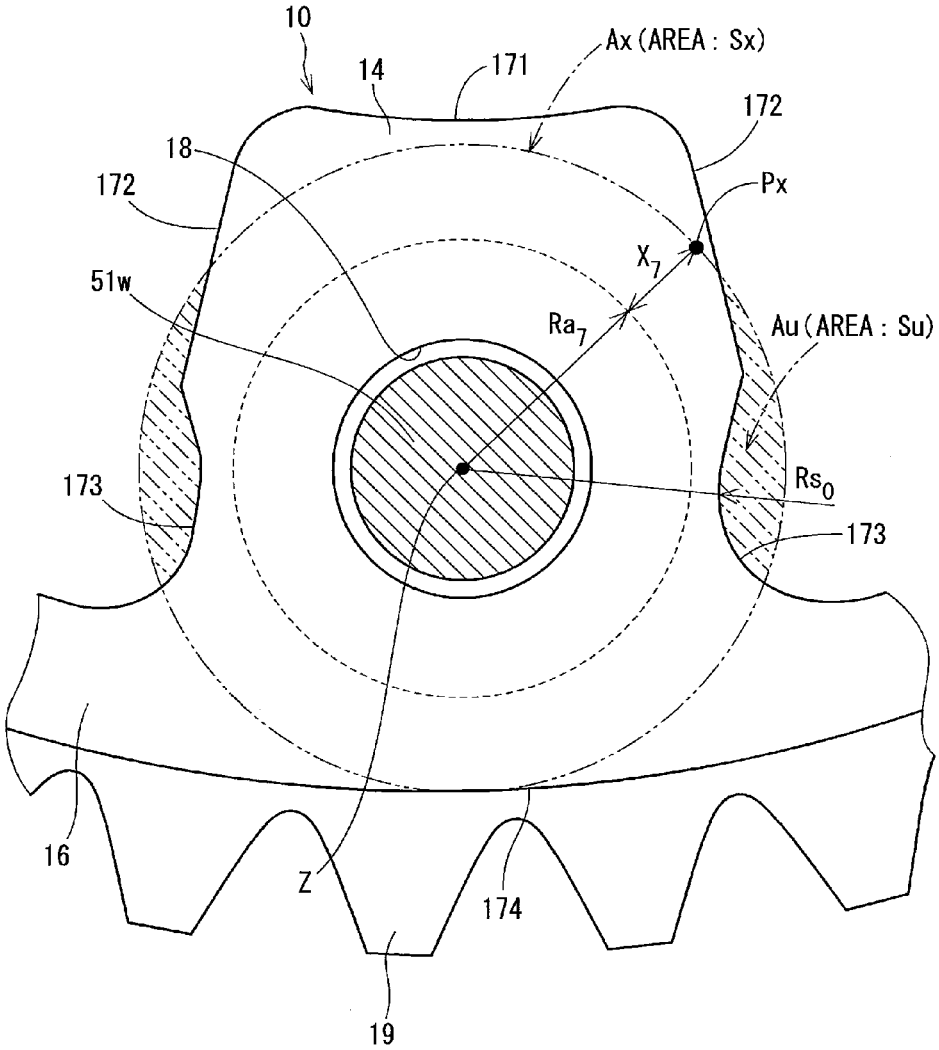
FIG. 15 is an enlarged view illustrating a shoe part of a valve timing control apparatus according to other embodiment.

In a modification shown in FIG. 15, an axial tension reach domain Ax is defined to be surrounded by a virtual circle with a double chain line which is defined by the axial tension reach point Px. An un-effective domain Au exists at adjacency of the cutout 173, where the axial tension reach domains Ax is located outside of the range of the shoe part 14. For example, the area Su of the un-effective domain Au is set to be smaller than or equal to 10% of the area Sx of the axial tension reach domain Ax. In other words, the area of the effective domain other than the un-effective domain Au is set to be larger than or equal to 90% of the area Sx of the axial tension reach domain Ax.

In this case, it becomes easy to obtain the effect of the present disclosure mostly even if it is not complete for aiming coexistence with other limitations on the product design. For example, compared with a case where the axial tension reach point Px is included in the range of the shoe part in all the directions, the action point radius $Ra_7$ and the diffusion length $X_7$ can be set larger in this case. Therefore, stress applied to the flat head bolt 51*w* can be reduced by using a flat head bolt 51*w* having a larger diameter.

The modification shown in FIG. 15 belongs to the technical scope of the present disclosure as equivalents.

In the first to the fifth embodiments, the front plate 3 is disposed to the end portion (left side of FIG. 1) of the hollow camshaft 93. In the sixth embodiment, the front plate 3 is disposed to the end portion (left side of FIG. 14) of the solid camshaft 93C.

The front plate is a plate to which the head 54 of flat head bolt 51 is seated, and is not limited in the relation with the camshaft. Therefore, the front plate may be arranged to the other end portion of the camshaft (right side of FIG. 1 and FIG. 14).

The number of the vane parts of the vane rotor and the number of the shoe parts of the shoe housing are not limited to four in the above embodiments.

The gear may be provided to not the shoe housing but to the front plate or the rear plate. Moreover, the component which transmits the power of the crankshaft and the camshaft may be a pulley and a timing belt etc. instead of the gear and the chain.

The oil passage change valve may be a direct type driven by an electric cylinder etc., or a pilot operation type.

The valve timing control apparatus may adjust the opening-and-closing timing of not only an intake valve but an exhaust valve.

The rotation shaft rotating with the vane rotor may not only a camshaft corresponding to a driven shaft but a crankshaft corresponding to a driving shaft.

Such changes and modifications are to be understood as being within the scope of the present disclosure as defined by the appended claims.

What is claimed is:

1. A valve timing control apparatus which controls opening-and-closing timing of an intake valve or an exhaust valve driven by a driven shaft by changing a rotation phase of the driven shaft to a driving shaft of an internal combustion engine, the valve timing control apparatus comprising:

a shoe housing which rotates with one of the driving shaft and the driven shaft, the shoe housing having a pipe part and a plurality of shoe parts projected inward in a radial direction from an inner wall of the pipe part, wherein the shoe housing has a shoe front surface which is a first axial end surface of the shoe housing and a shoe rear surface which is a second axial end surface of the shoe housing;

a vane rotor which rotates with the other of the driving shaft and the driven shaft, the vane rotor having a boss part which is coaxial with the pipe part of the shoe housing and a plurality of vane parts projected radially from the boss part, wherein the vane part is accommodated between the shoe parts in the shoe housing so that the vane part is able to rotate relative to the shoe part;

a front plate fixed to the shoe housing in a state where the front plate is in contact with the shoe front surface, the front plate having a seat surface with a concave taper shape at a position corresponding to the shoe part;

a rear plate fixed to the shoe housing in a state where the rear plate is in contact with the shoe rear surface; and a flat head bolt having a head and a seat surface which is seated on the seat surface of the front plate, the seat surface of the flat head bolt having a convex taper shape, wherein the flat head bolt passes through a through hole defined in the shoe part of the shoe housing such that the front plate and the rear plate are tightened with each other, or the flat head bolt is engaged with a female thread hole defined in the shoe part such that the front plate and the shoe housing are directly tightened with each other, the seat surface of the flat head bolt and the seat surface of the front plate are in contact with each other at an axial tension action point to which a tightening axial tension is applied in an axial cross-section, a normal vector which is perpendicular to the seat surface of the front plate and passes through the axial tension action point in the axial cross-section intersects the shoe front surface at an axial tension reach point, which is included in a range of the shoe part, wherein the seat surface of the flat head bolt has a first outer wall adjacent to a screw part, and a second outer wall adjacent to a head end surface, the axial tension action point at which the seat surface of the flat head bolt is in contact with the seat surface of the front plate is located between the first outer wall and the second outer wall, the first outer wall has a convex taper angle which is larger than a concave taper angle of the seat surface of the front plate, the second outer wall has a convex taper angle which is smaller than the concave taper angle of the seat surface of the front plate, and a clearance is defined between the first outer wall of the seat surface of the flat head bolt and the seat surface of the front plate.

2. The valve timing control apparatus according to claim 1, wherein the concave taper angle of the seat surface of the front plate has a fixed value from a first surface to a second surface of the front plate, the fixed value is different from the convex taper angle of the first outer wall, the fixed value is different from the convex taper angle of the second outer wall, and the seat surface of the front plate and the seat surface of the flat head bolt are brought into line contact.

3. The valve timing control apparatus according to claim 2, wherein the convex taper angle of the first outer wall is changed to the convex taper angle of the second outer wall at the axial tension action point, and the clearance causes the flat head bolt and the front plate to separate from each other except at the axial tension action point, and the clearance continues to extend along the screw part.

4. A valve timing control apparatus which controls opening-and-closing timing of an intake valve or an exhaust valve driven by a driven shaft by changing a rotation phase of the driven shaft to a driving shaft of an internal combustion engine, the valve timing control apparatus comprising:

a shoe housing which rotates with one of the driving shaft and the driven shaft, the shoe housing having a pipe part and a plurality of shoe parts projected inward in a radial direction from an inner wall of the pipe part, wherein the shoe housing has a shoe front surface which is a first axial end surface of the shoe housing and a shoe rear surface which is a second axial end surface of the shoe housing;

a vane rotor which rotates with the other of the driving shaft and the driven shaft, the vane rotor having a boss part which is coaxial with the pipe part of the shoe housing and a plurality of vane parts projected radially from the boss part, wherein the vane part is accommodated between the shoe parts in the shoe housing so that the vane part is able to rotate relative to the shoe part;

a front plate fixed to the shoe housing in a state where the front plate is in contact with the shoe front surface, the front plate having a seat surface with a concave taper shape at a position corresponding to the shoe part;

a rear plate fixed to the shoe housing in a state where the rear plate is in contact with the shoe rear surface; and a flat head bolt having a head and a seat surface which is seated on the seat surface of the front plate, the seat surface of the flat head bolt having a convex taper shape, wherein the flat head bolt passes through a through hole defined in the shoe part of the shoe housing such that the front plate and the rear plate are tightened with each other, or the flat head bolt is engaged with a female thread hole defined in the shoe part such that the front plate and the shoe housing are directly tightened with each other, the seat surface of the flat head bolt and the seat surface of the front plate are in contact with each other at an axial tension action point to which a tightening axial tension is applied in an axial cross-section, and a normal vector which is perpendicular to the seat surface of the front plate and passes through the axial tension action point in the axial cross-section intersects the shoe front surface at an axial tension reach point, which is included in a range of the shoe part, wherein the seat surface of the front plate has a first inner wall adjacent to a screw part, and a second inner wall adjacent to a head end surface, the axial tension action point at which the seat surface of the front plate is in contact with the seat surface of the flat head bolt is located between the first inner wall and the second inner wall, the first inner wall has a concave taper angle which is smaller than a convex taper angle of the seat surface of the flat head bolt, the second inner wall has a concave taper angle which is larger than the convex taper angle of the seat surface of the flat head bolt, and a clearance is defined between the first inner wall of the seat surface of the front plate and the seat surface of the flat head bolt.

5. The valve timing control apparatus according to claim 4, wherein the convex taper angle of the seat surface of the flat head bolt has a fixed value from a distal end to a proximal end of the flat head bolt, the fixed value is different from the concave taper angle of the first inner wall, the fixed value is different from the concave taper angle of the second inner wall, and the seat surface of the front plate and the seat surface of the flat head bolt are brought into line contact.

6. The valve timing control apparatus according to claim 5, wherein the concave taper angle of the first inner wall is changed to the concave taper angle of the second inner wall at the axial tension action point, the clearance causes the flat head bolt and the front plate to separate from each other except at the axial tension action point, and the clearance continues to extend along the screw part.

* * * * *